US010689936B2

(12) United States Patent
Fenwick

(10) Patent No.: US 10,689,936 B2
(45) **Date of Patent: *Jun. 23, 2020**

(54) TUBING HANGER SETTING CONFIRMATION SYSTEM

(71) Applicant: VETCO GRAY, LLC, Houston, TX (US)

(72) Inventor: Rodney Mark Fenwick, Aberdeen (GB)

(73) Assignee: VETCO GRAY, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/128,181

(22) Filed: Sep. 11, 2018

(65) Prior Publication Data

US 2019/0010776 A1 Jan. 10, 2019

Related U.S. Application Data

(63) Continuation of application No. 13/111,135, filed on May 19, 2011, now Pat. No. 10,077,622.

(51) Int. Cl.
*E21B 33/043* (2006.01)
*E21B 47/09* (2012.01)

(52) U.S. Cl.
CPC ..... *E21B 33/043* (2013.01); *E21B 47/09* (2013.01); *E21B 47/091* (2013.01)

(58) Field of Classification Search
CPC ..... E21B 33/043; E21B 47/09; E21B 47/091
See application file for complete search history.

(56) References Cited

U.S. PATENT DOCUMENTS

| | | | | |
|---|---|---|---|---|
| 2,201,311 | A | 5/1940 | Halliburton | |
| 3,017,931 | A | 1/1962 | Jackson | |
| 4,019,579 | A | 4/1977 | Thuse | |
| 4,284,142 | A * | 8/1981 | Kirkland | E21B 33/047 166/313 |

(Continued)

FOREIGN PATENT DOCUMENTS

| | | | |
|---|---|---|---|
| CN | 1039296 | A | 1/1990 |
| CN | 201024896 | Y | 2/2008 |

(Continued)

OTHER PUBLICATIONS

Unofficial English Translation of Chinese Office Action issued in connection with corresponding CN Application No. 201210243039.7.

(Continued)

*Primary Examiner* — James G Sayre
(74) *Attorney, Agent, or Firm* — Hogan Lovells US LLP

(57) ABSTRACT

A subsea wellhead assembly provides a positive indication of landing of a wellhead member and locking of a wellhead member to a wellhead. The subsea wellhead assembly includes at least one positive indicator assembly disposed within a wellhead member, and a communication line extending down a running string from a platform to a running tool disposed in a subsea wellhead. The at least one positive indicator assembly provides confirmation of setting of the wellhead member, and the communication line is in communication with the positive indicator assembly to communicate the confirmation of setting with the platform following setting of the wellhead member.

17 Claims, 5 Drawing Sheets

(56) References Cited

U.S. PATENT DOCUMENTS

| | | | | |
|---|---|---|---|---|
| 4,300,637 | A | 11/1981 | Valka | |
| 4,300,750 | A | 11/1981 | Valka | |
| 4,550,782 | A | 11/1985 | Lawson | |
| 4,634,152 | A | 1/1987 | Pettit | |
| 6,401,827 | B1 | 6/2002 | Ferguson et al. | |
| 6,516,876 | B1 | 2/2003 | Jennings | |
| 8,276,671 | B2 | 10/2012 | Neto | |
| 8,376,049 | B2 | 2/2013 | Bell | |
| 8,403,056 | B2 | 3/2013 | Gette | |
| 8,408,309 | B2 | 4/2013 | Eppinghaus | |
| 8,689,890 | B2 | 4/2014 | Tulapurkar | |
| 10,077,622 | B2 * | 9/2018 | Fenwick | E21B 33/043 |
| 2006/0021799 | A1 | 2/2006 | Hall | |
| 2008/0149390 | A1 | 6/2008 | Fraser et al. | |
| 2010/0326664 | A1 | 12/2010 | Neto et al. | |
| 2011/0083854 | A1 | 4/2011 | Jennings | |

FOREIGN PATENT DOCUMENTS

| | | | |
|---|---|---|---|
| CN | 101550811 | A | 10/2009 |
| CN | 10278784 | A | 11/2012 |
| GB | 2048991 | B | 12/1980 |
| GB | 2367079 | A | 3/2002 |
| WO | 2009017899 | | 2/2009 |

OTHER PUBLICATIONS

Search Report from corresponding GB Application No. GB1208759.9 dated Aug. 17, 2012.

* cited by examiner

TUBING HANGER SETTING CONFIRMATION SYSTEM

CROSS REFERENCE TO RELATED APPLICATIONS

This application is a continuation of U.S. patent application Ser. No. 13/111,135, filed a May 19, 2011, titled "TUBING HANGER SETTING CONFIRMATION SYSTEM," which is now U.S. Pat. No. 10,077,622, issued on Sep. 18, 2018, the full disclosure of which is hereby incorporated by reference in its entirety for all purposes.

BACKGROUND OF THE INVENTION

1. Field of the Invention

This invention relates in general to tubing hangers and, in particular, to an apparatus and method for providing confirmation of tubing hanger landing and confirmation of tubing hanger locking.

2. Brief Description of Related Art

A subsea well assembly includes a wellhead housing that is secured to a large diameter conductor pipe extending to a first depth in the well. After drilling to a second depth through the conductor pipe, a string of casing is lowered into the well and suspended in the wellhead housing by a casing hanger. A packoff seals between an outer diameter portion of the casing hanger and the bore of the wellhead housing. Some wells have two or more strings of casing, each supported by a casing hanger in the wellhead housing.

In one type of completion, a string of production tubing is lowered into the last string of casing. A tubing hanger lands and seals to the upper casing hanger. The production tubing string is suspended from the tubing hanger, and the well is then produced through the tubing. To suspend the production tubing from the tubing hanger, the tubing hanger must be landed within the wellhead and locked to the wellhead. This is necessary to prevent problems with the well during subsequent operations. Because landing and locking operations take place within the wellhead, there is no visible means to confirm that the tubing hanger has properly landed within the wellhead. In addition, there is no visible means to confirm that the tubing hanger has locked within the wellhead.

In order to determine if the tubing hanger has landed and locked, prior art embodiments will run the tubing hanger to the expected location within the wellhead. Then, the prior art embodiments perform the necessary procedures to lock the tubing hanger to the wellhead. The embodiments then conduct an overpull, i.e. pulling up on the running string suspending the tubing hanger running tool and the tubing hanger in the wellhead, to confirm that the tubing hanger has landed and locked within the wellhead. However, this is an imprecise measurement, and may provide a false indication of proper landing and locking. This is possible where the tubing hanger dogs did not properly engage the wellhead, causing the dogs to initially indicate proper locking through overpull, but the dogs then moving from the properly engaged position following execution of the test.

Another prior art method to confirm tubing hanger landing and tubing hanger locking involves monitoring well fluids returning from the well to the operating rig. The tubing hanger will include an actuation sleeve that engages tubing hanger dogs with a profile in the wellhead. The actuation sleeve is actuated hydraulically, and when fluid returns through the running string following performance of the land and lock operations, it is assumed that the tubing hanger has properly locked in the wellhead. However, the return of fluid through the tubing string only means that the actions have been performed, not that they operated properly or that the tubing hanger properly locked in the wellhead.

Some prior art running tools utilize a positive landing indicator to provide a positive indication of landing on a hanger disposed within a well. These positive landing indicators were positioned within the running tool and included an indicator stem disposed so as to contact and move axially upward in response to abutment of a downward facing rim of a sleeve of the running tool with an upward facing rim of the hanger. The positive landing indicator was connected to a communication line that provided fluid pressure to the positive landing indicator. When the indicator stem moved axially upward in response to landing on the hanger, fluid pressure would vent from the communication line. The venting of fluid pressure resulted in a pressure drop in the communication line that was measured at the operating platform. Unfortunately, this system was unable to provide an indication of landing and/or locking of the hanger when performing the initial run-in of the hanger into the well.

An apparatus or mechanism that could provide a positive indication of landing of the tubing hanger in the correct location is desirable. In addition, an apparatus or mechanism that could provide a positive indication of proper locking of the tubing hanger to the wellhead is desirable. Still further, an apparatus that could accomplish both operations is desirable.

SUMMARY OF THE INVENTION

These and other problems are generally solved or circumvented, and technical advantages are generally achieved, by preferred embodiments of the present invention that provide a tubing hanger landing confirmation system and a tubing hanger locking confirmation system, and a method for using the same.

In accordance with an embodiment of the present invention, a subsea wellhead assembly is disclosed. The subsea wellhead assembly includes a running tool adapted to be secured to a running string being lowered from a surface platform and a wellhead member releasably coupled to the running tool. The wellhead member will land within a subsea wellhead. At least one positive indicator assembly is disposed within the wellhead member. The indicator assembly has an indicator stem that is adapted to move relative to the wellhead member when a specified function in the wellhead member occurs. A communication line connects to the running tool and extends alongside the running string to the platform. An indication of movement of the indicator assembly is transmitted through the communication line to the platform.

In accordance with another embodiment of the present invention, a subsea wellhead assembly is disclosed. The subsea wellhead assembly includes a pipe hanger having an actuation sleeve that is axially moveable from an upper to a lower position relative to an axis of the pipe hanger. The subsea wellhead assembly also includes a running tool for installing the pipe hanger within a subsea wellhead and axially moving the actuation sleeve. At least one positive indicator assembly is disposed within the pipe hanger. The indicator assembly has an indicator stem that moves from an extended position to a retracted position when the actuation sleeve moves to the lower position. The subsea wellhead assembly also includes a control unit adapted to be located at a surface platform and a communication line extending between the positive indicator assembly and the control unit. The control unit provides a fluid pressure thru the communication line that changes when the indicator stem moves to the retracted position.

In accordance with yet another embodiment of the present invention, a method for providing a positive indication of wellhead member setting is disclosed. The method begins by providing at least one positive indicator assembly in the wellhead member. The indicator assembly has an indicator stem that moves from an extended to a retracted position. Next, the method provides a communication line between the positive indicator assembly and a surface platform. The method then runs the wellhead member on a running tool to a predetermined location within a wellhead, and performs a specified function with the wellhead member. In response to the specified function, the method causes the indicator stem to move to the retracted position and transmits an indication through the communication line that the indicator stem has moved to the retracted position.

An advantage of a preferred embodiment is that it provides a positive indication of landing of the tubing hanger in the correct location. In addition, the preferred embodiments provide a positive indication of proper locking of the tubing hanger to the wellhead or tubing hanger spool. Still further, the preferred embodiments provide a positive indication of both landing and locking of the tubing hanger in the wellhead or tubing hanger spool.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout, and the prime notation, if used, indicates similar elements in alternative embodiments.

In the following discussion, numerous specific details are set forth to provide a thorough understanding of the present invention. However, it will be obvious to those skilled in the art that the present invention may be practiced without such specific details. Additionally, for the most part, details concerning rig operations, wellbore drilling, wellhead placement, tubing hanger spool placement, and the like have been omitted inasmuch as such details are not considered necessary to obtain a complete understanding of the present invention, and are considered to be within the skills of persons skilled in the relevant art.

Figure 1:
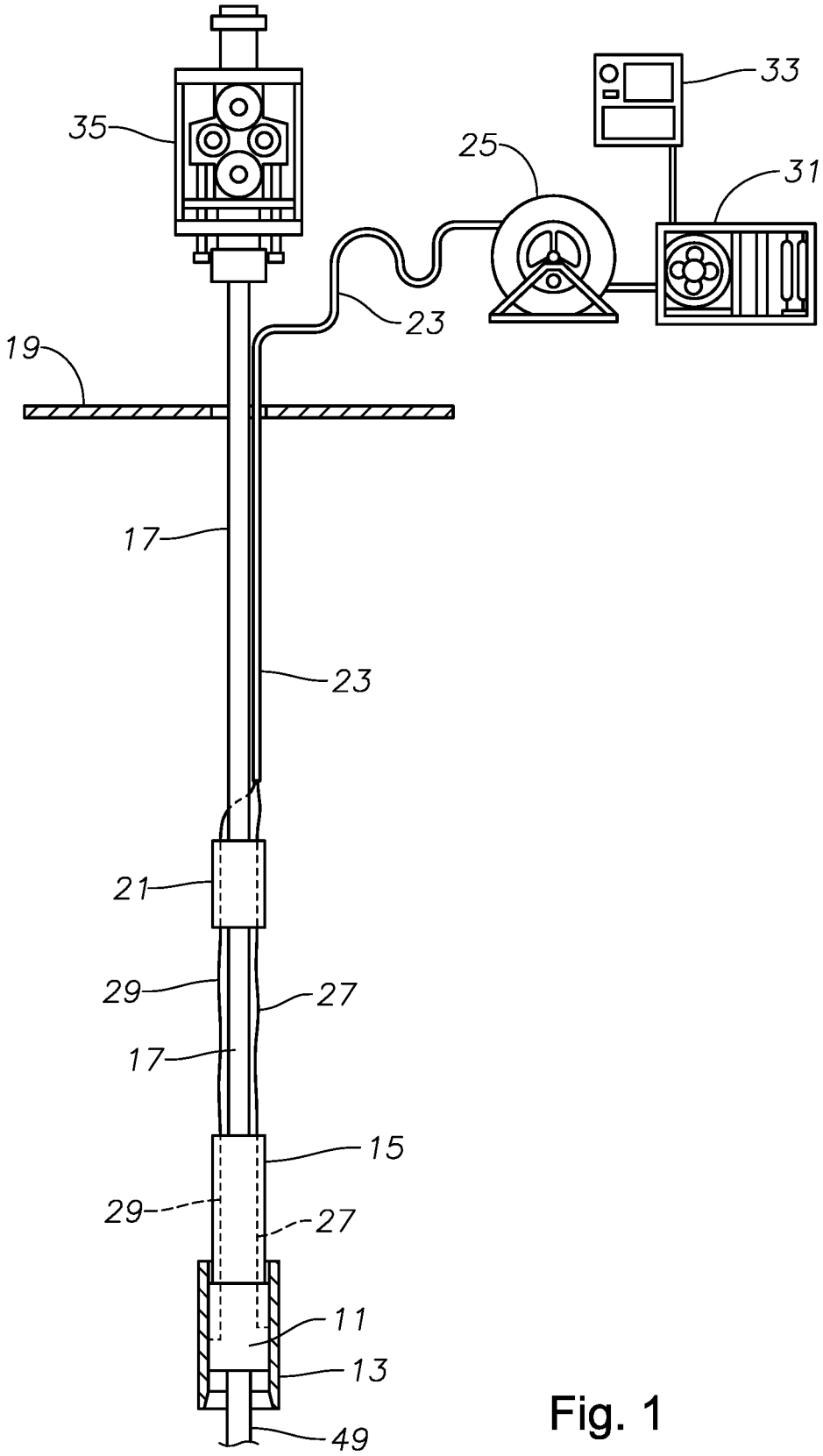
FIG. 1 is a schematic illustration of a tubing hanger land and lock confirmation system disposed within a tubing hanger spool.

Referring to FIG. 1, a tubing hanger 11, or other wellhead member such as a casing hanger or pipe hanger, is landed in a wellhead assembly 13 at a subsea location. Wellhead assembly 13 may comprise any suitable wellhead component such as a tubing hanger spool, subsea tree, or wellhead. Tubing hanger 11 is run to the location shown in FIG. 1 by a tubing hanger running tool 15. Tubing hanger running tool 15 is suspended from a running string 17. Running string 17 may be suspended in an opening in a rig floor 19 by a test tree 35. Test tree 35 may control the flow of fluid through running string 17, allowing for fluid communication with tubing hanger running tool 15 and other subsea devices.

In the illustrated embodiment, running string 17 includes adapters, slick joints, shear subs, various intermediate joints and adapters, and a cased wear joint at rig floor 19. Running string 17 may also include an umbilical termination assembly 21. An umbilical 23 may run from umbilical termination assembly 21 to an umbilical reel 25 located at rig floor 19. A locking communication flow line 27, and a landing communication flow line 29 may be carried by umbilical 23 to umbilical reel 25, and then to a high pressure unit 31 located at rig floor 19. High pressure unit 31 will be able to monitor and supply fluid pressure to locking communication flow line 27 and landing communication flow line 29, and will include a control unit 33 or other device to communicate pressure changes within locking communication flow line 27 and landing communication flow line 29 to an operator located at rig floor 19. A person of ordinary skill in the art will understand that high pressure unit 31 and control unit 33 may comprise a single unit in alternative embodiments. These embodiments are contemplated and included herein. Locking communication flow line 27 and landing communication flow line 29 may be carried by running string 17 below umbilical termination assembly 21 so that the locking communication flow line 27 and the landing communication flow line 29 may communicate with sub assemblies located in tubing hanger running tool 15 and tubing hanger 11.

Figure 2:
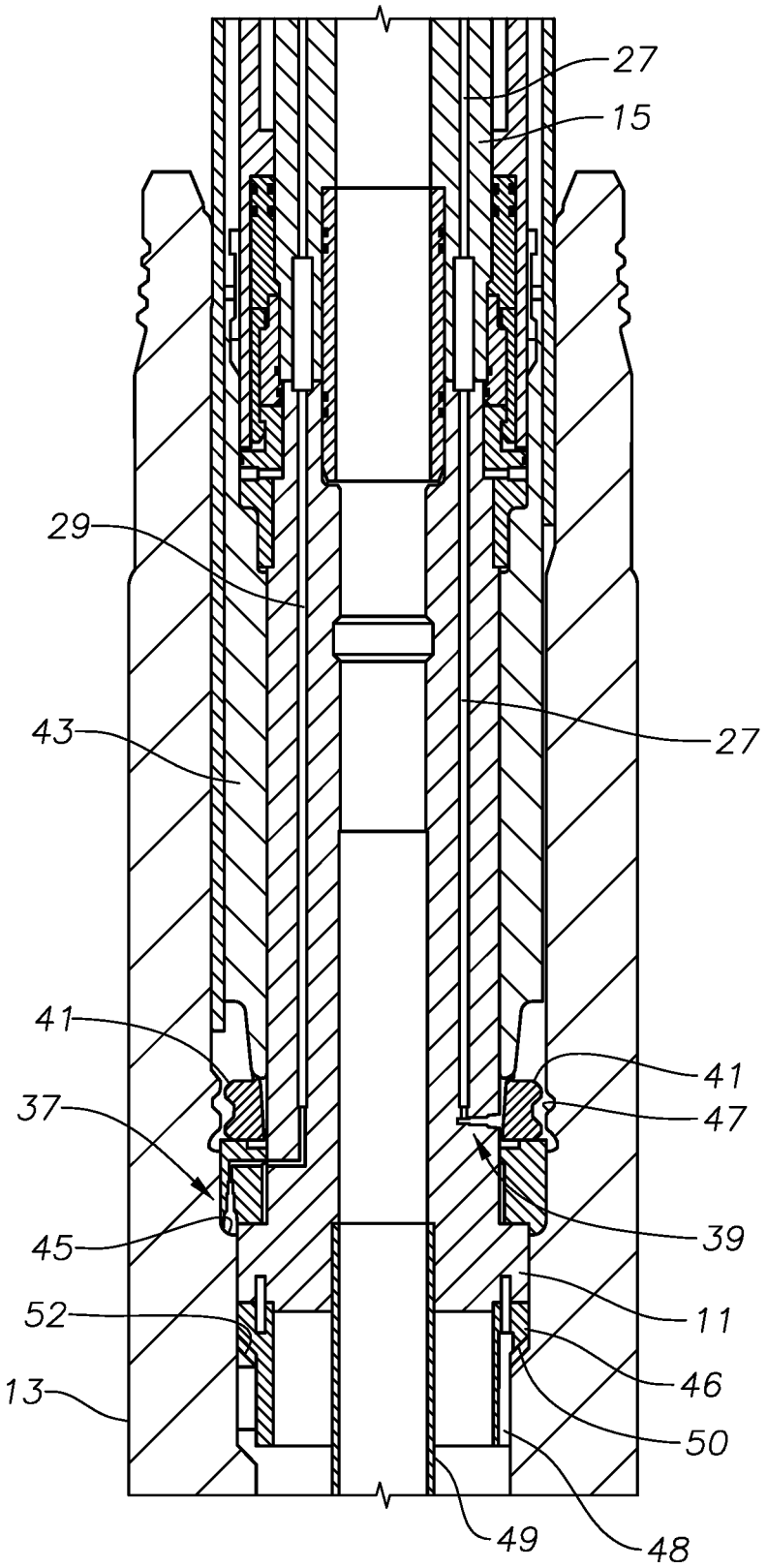
FIG. 2 is schematic illustration of a portion of the tubing hanger land and lock system of FIG. 1.

As shown in FIG. 2, tubing hanger 11 may include at least one positive indicator assembly, such as a landing confirmation assembly 37, and a locking confirmation assembly 39. Locking communication flow line 27 may be in fluid communication with locking confirmation assembly 39, and landing communication flow line 29 may be in fluid communication with landing confirmation assembly 37. Tubing hanger 11 also includes locking members, such as locking dogs 41, and an actuation sleeve 43. Tubing hanger 11 may be suspended by tubing hanger running tool 15 within wellhead assembly 13. Tubing hanger 11 may include a landing ring 46 mounted to a lower rim of tubing hanger 11. Landing ring 46 may have an exterior diameter approximately equal to the exterior diameter of tubing hanger 11 and a lower portion 48 having an exterior diameter smaller than the exterior diameter of tubing hanger 11. Landing ring 46 may taper from the portion having an exterior diameter approximately equal to tubing hanger 11 to lower portion 48 such that the taper may form an annular downwardly and radially outwardly facing shoulder 50. Wellhead assembly 13 may define an annular upwardly and radially inwardly facing shoulder 52 on the inner diameter of wellhead assembly 13. Tubing hanger running tool 15 may then land tubing hanger 11 on annular shoulder 52 of wellhead assembly 13. When landed, locking dogs 41 of tubing hanger 11 will be proximate to an annular profile 47 of wellhead assembly 13. Tubing hanger running tool 15 will then operate to cause actuation sleeve 43 to urge locking dogs 41 outward into engagement with annular profile 47, locking tubing hanger 11 into wellhead assembly 13 so that production tubing 49 coupled to tubing hanger 11 may be suspended into the well below wellhead assembly 13 as shown in FIG. 2. A person skilled in the art will understand that tubing hanger 11 may be landed on a casing hanger and locked to a wellhead, a tubing hanger spool, or a subsea tree in the process described herein. The disclosed embodiments contemplate and include such alternate embodiments.

Figure 3:
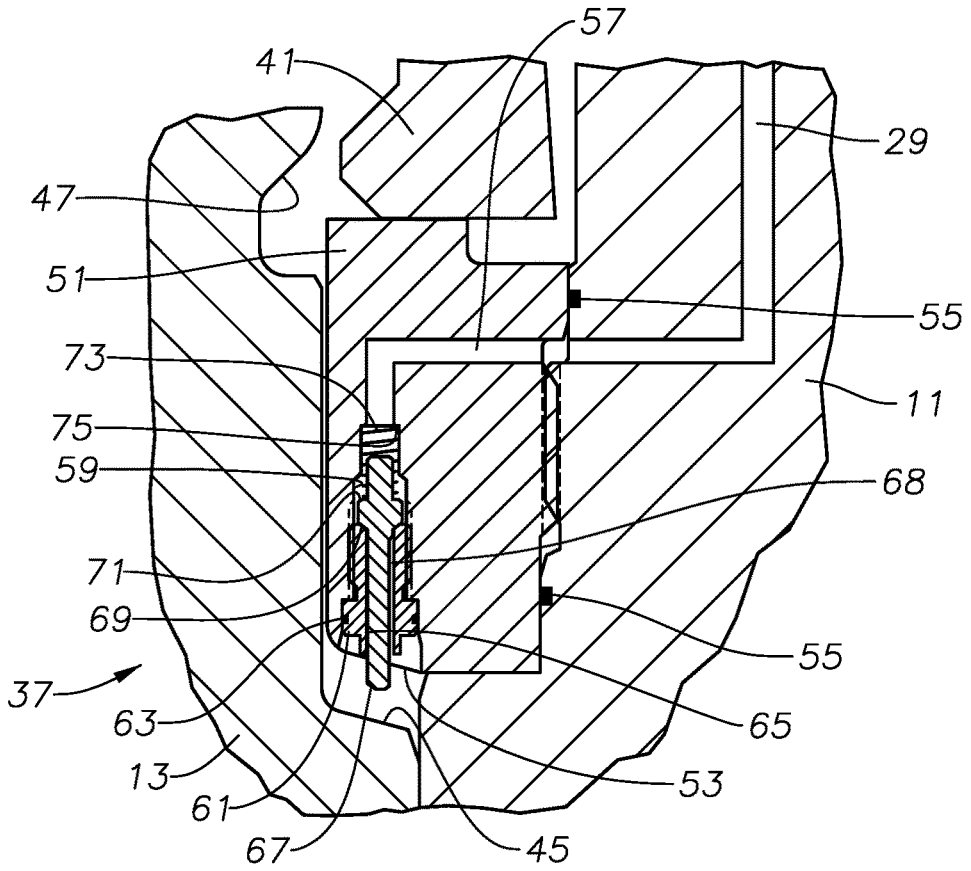
FIG. 3 is a schematic illustration of the tubing hanger land confirmation system of FIG. 2 just prior to landing.

Referring to FIG. 3, landing confirmation assembly 37 may include a dog cage 51 secured to an exterior of tubing hanger 11. When tubing hanger 11 lands on upwardly facing shoulder 52 (not shown) in wellhead assembly 13, a downward facing shoulder 53 of dog cage 51 may land out above an annular upward facing shoulder 45 of wellhead assembly 13. Annular upward facing shoulder 45 may be proximate to but axially below profile 47 and axially above annular upwardly facing shoulder 52. Dog cage 51 may be an annular body secured to tubing hanger 11 by any suitable means. Alternatively, dog cage 51 may be a protrusion formed in tubing hanger 11 as an integral component of tubing hanger 11. In the illustrated embodiment, dog cage 51 secures to tubing hanger 11 through a threaded connection. Landing confirmation flow line 29 will pass through running tool 15 (not shown) and tubing hanger 11 to terminate at the outer diameter of tubing hanger 11 proximate to dog cage 51. Dog cage 51 will include a landing confirmation assembly flow line 57 extending from an inner diameter of dog cage 51. In the illustrated embodiment, an end of landing confirmation assembly flow line 57 is proximate to the termination of landing confirmation flow line 29. O-ring seals 55 will seal the outer diameter of tubing hanger 11 to the inner diameter of dog cage 51 so that landing confirmation flow line 29 and landing confirmation assembly flow line 57 may be in fluid communication with each other.

Dog cage 51 also includes an indicator bore 59. Indicator bore 59 extends axially upward from downward facing shoulder 53. Landing confirmation assembly flow line 57 will extend from the inner diameter surface of dog cage 51 to indicator bore 59. In the illustrated embodiment, at least a portion of indicator bore 59 is threaded so that an outer diameter of an indicator housing 61 may be threaded into indicator bore 59 through a matching thread on the outer diameter of indicator housing 61. Indicator housing 61 may carry an o-ring seal 63 on the outer diameter of indicator housing 61 so that indicator housing 61 may seal to indicator bore 59.

Indicator housing 61 will define a central passage 65 through which an indicator stem 67 will pass. An outer diameter of indicator stem 67 may be substantially equal to the diameter of central passage 65; however, a flat 68 may be machined on a portion of indicator stem 67 so that fluid may flow through central passage 65 past indicator stem 67. Indicator stem 67 will define a downward facing shoulder 69 and an upward facing shoulder 71. Downward facing shoulder 69 may be adapted to land on an interior rim of indicator housing 61 so that indicator housing 61 will retain indicator stem 67 to dog cage 51. Upward facing shoulder 71 may be adapted to accept an end of a spring 73, the opposite end of which rests on a shoulder 75 defined by indicator bore 59 formed at a junction of indicator bore 59 and landing confirmation assembly flow line 57. Movement of indicator stem 67 through central passage 65 may cause spring 73 to compress between upward facing shoulder 71 and shoulder 75 such that spring 73 will exert a force on indicator stem 67, biasing indicator stem 67 to land downward facing shoulder 69 on indicator housing 61 in an extended position. In this manner, spring 73 will cause shoulder 69 to seal to the rim of indicator housing 61, preventing flow of fluid within landing communication lines 57, 29 through central passage 65 past flat 68. In addition, indicator stem 67 will have a length such that an end of indicator stem 67 will protrude below shoulder 53 when shoulder 69 abuts the rim of indicator housing 61 in the extended position. The end of indicator stem 67 protruding below shoulder 53 may also include a taper to match any taper of landing shoulder 45 of wellhead assembly 13.

Landing confirmation assembly 37 may operate as described below. Description of the movement of tubing hanger 11 as a staged process throughout the landing operation is done for ease of explanation and description. A person skilled in the art will understand that the running and landing of tubing hanger 11 within wellhead assembly 13 may be a relatively continuous movement process. Throughout the operation, high pressure unit 31 may supply fluid pressure through landing communication flow line 29. Tubing hanger 11 will be run to a subsea location within wellhead assembly 13 such that downward facing shoulder 53 of dog cage 51 will be axially above upward facing shoulder 45 of wellhead assembly 13. Downward facing shoulder 69 of indicator stem 67 will abut the upper rim of indicator housing 61 such that an end of indicator stem 67 will protrude below downward facing shoulder 53 in the extended position as shown in FIG. 3. Tubing hanger 11 will be moved axially downward bringing the end of indicator stem 67 proximate to upward facing shoulder 45. Further downward movement of tubing hanger 11 relative to wellhead assembly 13 will cause the end of indicator stem 67 to contact upward facing shoulder 45.

Figure 4:
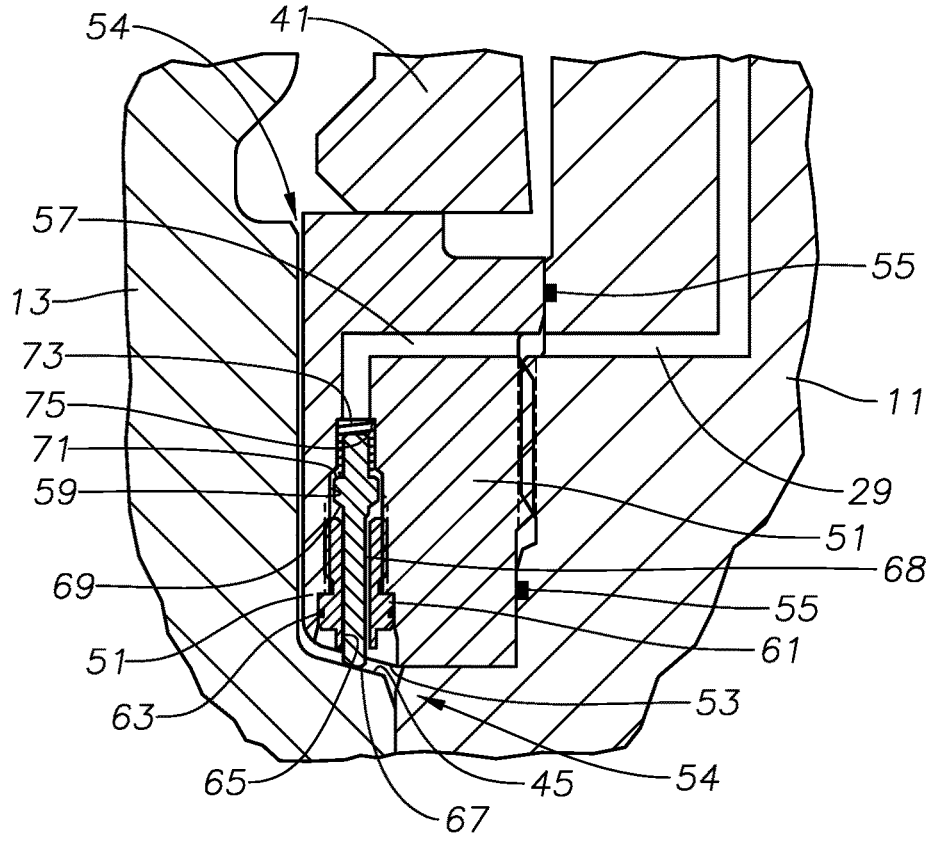
FIG. 4 is a schematic illustration of the tubing hanger land confirmation system of FIG. 2 just after landing.

As shown in FIG. 4, continued axially downward movement of tubing hanger 11 will cause downward facing shoulder 53 to land out above upward facing shoulder 45 such that a gap 54 may exist between shoulders 45, 53 and the inner diameter of wellhead assembly 13 and dog cage 51. Gap 54 be any suitable size such that fluid may flow from indicator bore 59 through gap 54. As a result, indicator stem 67 will move into indicator housing 61 into a retracted position. This will force the opposite end of indicator stem 67 toward landing confirmation assembly flow line 57 such that shoulder 69 is no longer in contact with the upper rim of indicator housing 61. This will cause a decrease in pressure in landing confirmation assembly flow line 57, and consequently landing communication flow line 29 as fluid vents past indicator stem 67 and through indicator housing 61. This pressure decrease will be read by high pressure unit 31. High pressure unit 31 will then provide an indication to an operator of the decrease in pressure through control unit 33, notifying the operator of a successful landing of tubing hanger 11.

Figure 4A:
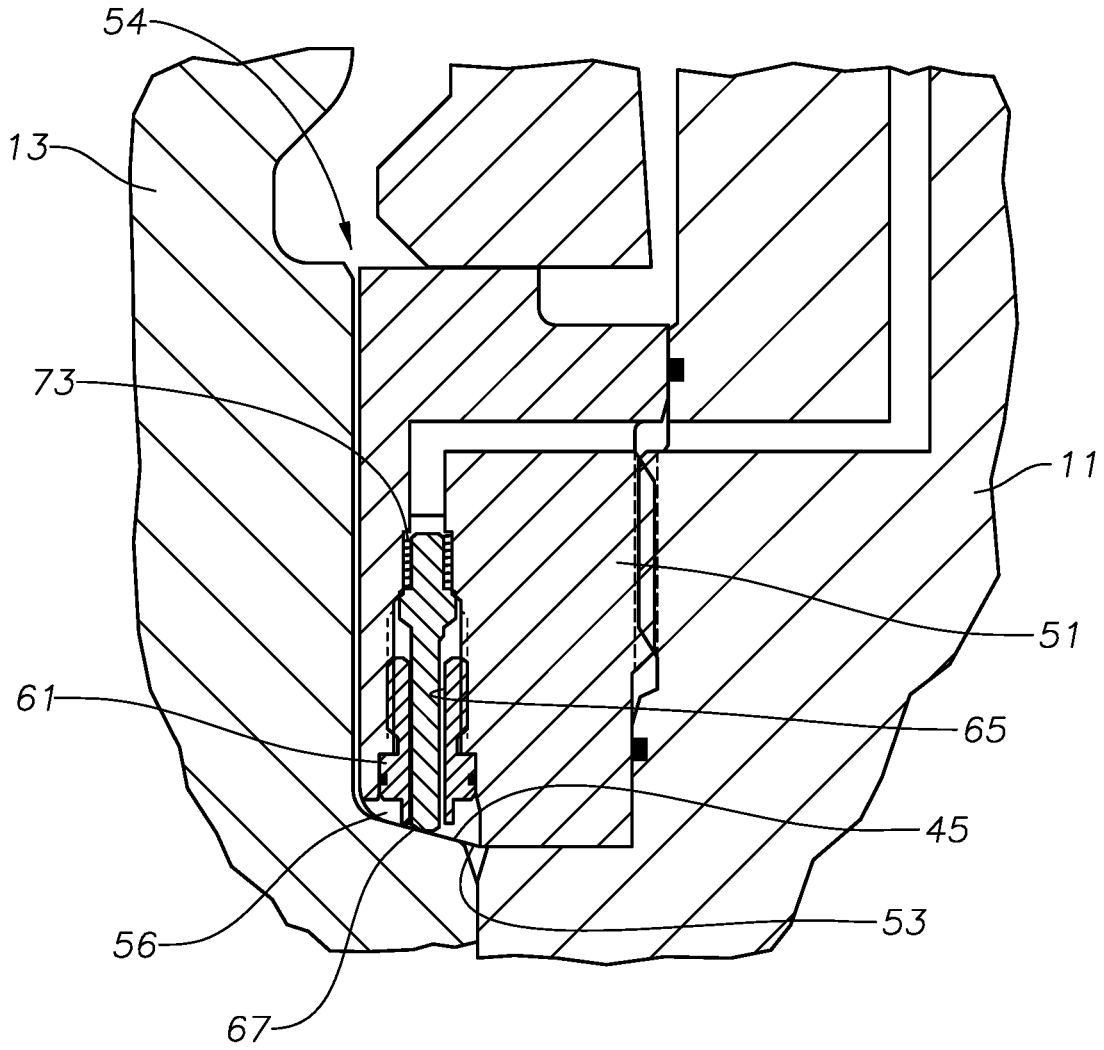
FIG. 4A is a schematic illustration of an alternative embodiment of the tubing hanger land confirmation system of FIG. 4.

In an alternative embodiment, dog cage 51 may support tubing hanger 11 within wellhead assembly 13. In these embodiments, landing ring 46 may not be mounted to tubing hanger 11. Instead, dog cage 51 will be mounted to tubing hanger 11 such that dog cage 51 may support the weight of tubing hanger 11 and tubing string 49 within wellhead assembly 13. As shown in FIG. 4A, downward facing shoulder 53 of dog cage 51 will land on and abut upward facing shoulder 45 of wellhead assembly 13. As described above with respect to FIG. 3 and FIG. 4, indicator stem 67 may move into indicator housing 61, opening indicator housing passage 65 for flow of fluid from landing confirmation assembly flow line 57 through passage 65. Indicator housing 61 and dog cage 51 may include a venting port 56 extending from passage 65 to an exterior of dog cage 51 proximate to the inner diameter of wellhead assembly 13. Thus, when upward facing shoulder 45 and downward facing shoulder 53 abut, landing confirmation assembly flow line 57 may vent through venting port 56 to provide a positive indication of landing.

Figure 5:
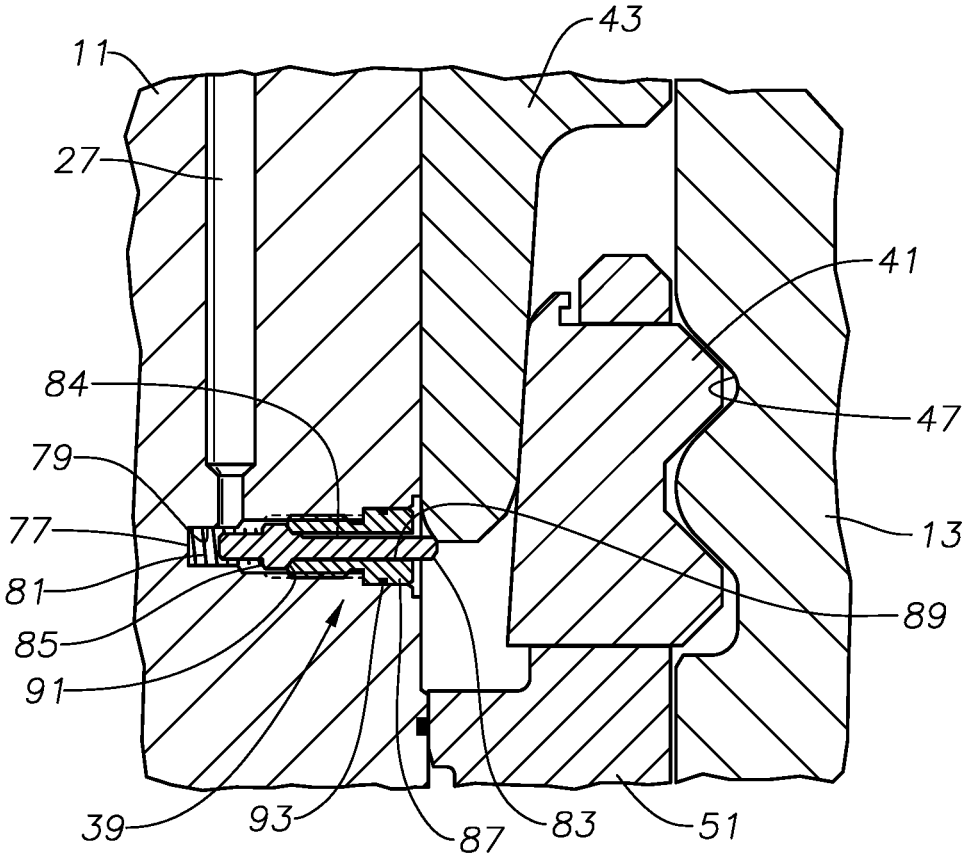
FIG. 5 is a schematic illustration of a portion of a tubing hanger lock confirmation system of FIG. 2 just prior to locking.

Referring now to FIG. 5, locking confirmation assembly 39 is disposed within a locking indicator bore 79, proximate to an end of actuation sleeve 43 and locking dog 41. Locking indicator bore 79 will be formed in a sidewall of tubing hanger 11 and extend radially inward from an outer diameter of tubing hanger 11, terminating at a terminus 77 just past an end of locking confirmation flow line 27. A spring 81 will be positioned within locking indicator bore 79 so that spring 81 may be compressed against terminus 77 of locking indicator bore 79. Locking confirmation flow line 27 may communicate with locking indicator bore 79 at terminus 77 of locking indicator bore 79. A locking indicator stem 83 will have an end positioned within spring 81 and define a radially inward facing shoulder 85. An end of spring 81 opposite terminus 77 of locking indicator bore 79 will abut inward facing shoulder 85 so that locking indicator stem 83 may compress spring 81 against terminus 77 of locking indicator bore 79. In the illustrated embodiment, at least a portion of locking indicator bore 79 is threaded so that an outer diameter of an indicator housing 87 may be threaded into locking indicator bore 79 through a matching thread on the outer diameter of indicator housing 87. Indicator housing 87 may carry an o-ring seal 93 on the outer diameter of indicator housing 87 so that indicator housing 87 may seal to locking indicator bore 79. An outer diameter of indicator stem 83 may be substantially equal to the diameter of central passage 89; however, a flat 84 may be machined on a portion of indicator stem 83 so that fluid may flow through central passage 89 past indicator stem 83.

Movement of indicator stem 83 through central passage 89 may cause spring 81 to compress between shoulder 85 and terminus 77 such that spring 81 will exert a force on indicator stem 83 biasing indicator stem 83 to land shoulder 91 on indicator housing 87. In this manner, spring 81 will cause shoulder 91 to seal to the rim of indicator housing 87, preventing flow of fluid within locking communication line 27 out of central passage 89 past flat 84. In addition, indicator stem 83 will have a length such that an end of indicator stem 83 will protrude beyond the outer diameter of tubing hanger 11 when shoulder 91 abuts the rim of indicator housing 87 in an extended position. The end of indicator stem 83 protruding beyond the outer diameter of tubing hanger 11 may also include a taper to match any taper of actuation sleeve 43 of tubing hanger 11.

Figure 6:
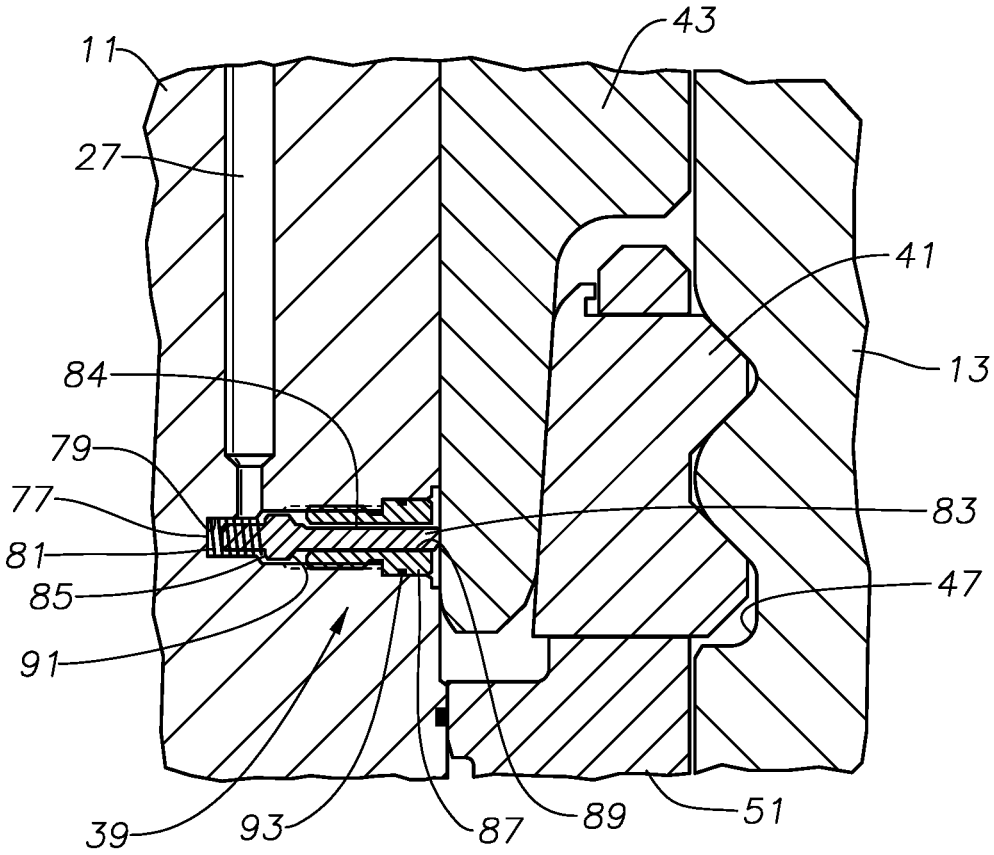
FIG. 6 is a schematic illustration of the portion of the tubing hanger lock confirmation system of FIG. 2 just after locking.

Prior to locking of tubing hanger 11 to wellhead assembly 13, an end of locking indicator stem 83 will protrude beyond the outer diameter of tubing hanger 11 in an extended position. After landing of tubing hanger 11 on wellhead assembly 13, actuation sleeve 43 will be moved downward by tubing hanger running tool 15. As a result, an end of actuation sleeve 43 will move between tubing hanger 11 and locking dogs 41. This will urge locking dogs 41 radially outward into engagement with profile 47 of wellhead assembly 13. As actuation sleeve 43 moves radially downward between tubing hanger 11 and locking dogs 43, an end of actuation sleeve 43 will come close to and touch the end of locking indicator stem 83. Referring to FIG. 6, as actuation sleeve 43 continues moving axially downward between tubing hanger 11 and locking dogs 41, actuation sleeve 43 will force locking indicator stem 83 radially inward into a retracted position. This will cause the opposite end of locking indicator stem 83 to move toward the terminus of locking indicator bore 79, allowing fluid in locking indicator bore 79 to flow past indicator stem 83 at flat 84. This will cause a decrease in pressure in locking communication flow line 27. This pressure decrease will be read by high pressure unit 31. High pressure unit 31 will then provide an indication to an operator of the decrease in pressure through control unit 33, notifying the operator of a successful locking of tubing hanger 11 to wellhead assembly 13.

Accordingly, the disclosed embodiments provide numerous advantages. For example, the disclosed embodiments provide a means to determine a successful landing of a tubing hanger in tubing hanger spools, subsea trees, or wellheads. In addition, the disclosed embodiments provide a means to determine whether the tubing hanger has properly locked to the tubing hanger spool, subsea tree or wellhead. Furthermore, the disclosed embodiments provide a means to determine whether the tubing hanger has properly landed and locked to the tubing hanger spool, subsea tree, or wellhead.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A method for providing a positive indication of wellhead member setting, comprising:

(a) providing at least one positive indicator assembly in the wellhead member, the indicator assembly having an indicator stem that moves from an extended to a retracted position;

(b) providing a communication line between the positive indicator assembly and a surface platform, the communication line having a first end at the surface platform and a second end at the positive indicator assembly;

(c) running the wellhead member on a running tool to a predetermined location within a wellhead;

(d) landing a downward facing shoulder of the wellhead member on an upward facing shoulder of the wellhead; then (e) moving the indicator stem to the retracted position in response to contact of an end of the indicator stem with the upward facing shoulder of the wellhead; and (f) transmitting an indication through the communication line that the indicator stem has moved to the retracted position.

2. The method of claim 1, wherein:

step (a) comprises providing a landing and a setting positive indicator assembly, each having an indicator stem;

step (d) further comprises moving an actuation sleeve of the wellhead member to urge a locking member of the wellhead member radially outward into engagement with a profile in the wellhead; and step (e) further comprises moving the indicator stem of the locking positive indicator assembly to the retracted position in response to contact of an end of the indicator stem with the actuation sleeve of the wellhead member.

3. The method of claim 1, wherein step (d) further comprises supplying fluid pressure to the communication flow line prior to performing the specified function.

4. The method of claim 1, wherein when the indicator stem is in the extended position, the communication line is closed at the second end thereof.

5. The method of claim 1, wherein when the indicator stem is in the retracted position, the communication line is open at the second end thereof.

6. The method of claim 1, wherein the positive indicator assembly includes an annular indicator housing that surrounds a portion of the indicator stem and has a sealing surface, and wherein the indicator stem has a radially protruding shoulder that seals against the sealing surface of the indicator housing when the indicator stem is in the extended position, thereby closing the communication line.

7. The method of claim 6, wherein the positive indicator assembly includes a spring that contacts the indicator stem and pushes the indicator stem into the extended position so that the shoulder of the indicator stem seals against the sealing surface of the indicator housing.

8. A method for providing a positive indication of wellhead member setting, comprising:

(a) providing at least one positive indicator assembly in the wellhead member, the indicator assembly having an indicator stem that moves from an extended to a retracted position;

(b) providing a communication line between the positive indicator assembly and a surface platform, the communication line having a first end at the surface platform and a second end at the positive indicator assembly;

(c) running the wellhead member on a running tool to a predetermined location within a wellhead;

(d) moving an actuation sleeve of the wellhead member to urge a locking member of the wellhead member radially outward into engagement with a profile in the wellhead; then (e) causing the indicator stem to move to the retracted position in response to contact of an end of the indicator stem with the actuation sleeve; and (f) transmitting an indication through the communication line that the indicator stem has moved to the retracted position.

9. The method of claim 8, wherein when the indicator stem is in the extended position, the communication line is closed at the second end thereof.

10. The method of claim 8, wherein when the indicator stem is in the retracted position, the communication line is open at the second end thereof.

11. The method of claim 8, wherein the positive indicator assembly includes an annular indicator housing that surrounds a portion of the indicator stem and has a sealing surface, and wherein the indicator stem has a radially protruding shoulder that seals against the sealing surface of the indicator housing when the indicator stem is in the extended position, thereby closing the communication line.

12. The method of claim 11, wherein the positive indicator assembly includes a spring that contacts the indicator stem and pushes the indicator stem into the extended position so that the shoulder of the indicator stem seals against the sealing surface of the indicator housing.

13. A method for providing a positive indication of wellhead member setting, comprising:

(a) providing at least one positive indicator assembly in the wellhead member, the indicator assembly having an indicator stem that moves from an extended to a retracted position;

(b) providing a communication line between the positive indicator assembly and a surface platform, the communication line having a first end at the surface platform and a second end at the positive indicator assembly;

(c) running the wellhead member on a running tool to a predetermined location within a wellhead;

(d) landing a downward facing shoulder of the wellhead member on an upward facing shoulder of the wellhead, and moving an actuation sleeve of the wellhead member to urge a locking member of the wellhead member radially outward into engagement with a profile in the wellhead; and (e) moving the indicator stem of the landing positive indicator assembly to the retracted position in response to contact of an end of the indicator stem with the upward facing shoulder of the wellhead, and moving the indicator stem of the locking positive indicator assembly to the retracted position in response to contact of an end of the indicator stem with the actuation sleeve of the wellhead member; and (f) transmitting an indication through the communication line that the indicator stem has moved to the retracted position.

14. The method of claim 13, wherein when the indicator stem is in the extended position, the communication line is closed at the second end thereof.

15. The method of claim 13, wherein when the indicator stem is in the retracted position, the communication line is open at the second end thereof.

16. The method of claim 13, wherein the positive indicator assembly includes an annular indicator housing that surrounds a portion of the indicator stem and has a sealing surface, and wherein the indicator stem has a radially protruding shoulder that seals against the sealing surface of the indicator housing when the indicator stem is in the extended position, thereby closing the communication line.

17. The method of claim 16, wherein the positive indicator assembly includes a spring that contacts the indicator stem and pushes the indicator stem into the extended position so that the shoulder of the indicator stem seals against the sealing surface of the indicator housing.

* * * * *